US009451658B2

(12) United States Patent
Baxter et al.

(10) Patent No.: US 9,451,658 B2
(45) Date of Patent: Sep. 20, 2016

(54) INDUCTION OVEN FOR CURING COATINGS ON CONTAINERS

(75) Inventors: Raymond Baxter, Vermilion, OH (US); Howard Podolny, Medina, OH (US); Robert Zuccarelli, Amherst, OH (US)

(73) Assignee: Nordon Corporation, Westlake, OH (US)

( * ) Notice: Subject to any disclaimer, the term of this patent is extended or adjusted under 35 U.S.C. 154(b) by 1054 days.

(21) Appl. No.: 13/104,235

(22) Filed: May 10, 2011

(65) Prior Publication Data

US 2012/0288638 A1 Nov. 15, 2012

(51) Int. Cl.

| | |
|---|---|
| ***H05B 6/04*** | (2006.01) |
| ***B05D 3/02*** | (2006.01) |
| ***H05B 6/10*** | (2006.01) |

(52) U.S. Cl.

CPC ..... *H05B 6/107* (2013.01); *H05B 6/103* (2013.01)

(58) Field of Classification Search

CPC ..... H05B 6/36; H05B 6/102; H05B 6/107; H05B 6/365; H05B 6/02; H05B 6/103; H05B 6/362

USPC ..... 219/624, 630, 601, 602, 635, 653, 660; 427/543; 198/345.3, 369.6, 370.02, 198/370.08, 370.13, 377.02, 379

See application file for complete search history.

(56) References Cited

U.S. PATENT DOCUMENTS

| | | | | |
|---|---|---|---|---|
| 3,056,876 A * | 10/1962 | Schmidt | | 219/656 |
| 3,251,976 A | 5/1966 | McBrien | | |
| 4,050,888 A * | 9/1977 | Pfister et al. | | 432/124 |
| 4,082,936 A * | 4/1978 | Aoki | H05B 6/365 | 219/635 |
| 4,456,804 A | 6/1984 | Lasky et al. | | |
| 4,754,113 A * | 6/1988 | Mohr et al. | | 219/673 |
| 5,169,621 A * | 12/1992 | DiMaio et al. | | 427/195 |

(Continued)

FOREIGN PATENT DOCUMENTS

| | | |
|---|---|---|
| CN | 1820085 | 8/2006 |
| DE | 26 32 153 | 2/1977 |

(Continued)

OTHER PUBLICATIONS

International Preliminary Report on Patentability dated Nov. 12, 2013 for corresponding International Patent Application No. PCT/US2012/034874.

International Search Report dated Jul. 24, 2012, for International Application Serial No. PCT/US2012/034874.

Written Opinion dated Jul. 24, 2012, for International Application Serial No. PCT/US2012/034874.

(Continued)

*Primary Examiner* — Dana Ross
*Assistant Examiner* — James Sims, III
(74) *Attorney, Agent, or Firm* — Baker & Hostetler LLP

(57) ABSTRACT

An induction heater includes an electrically conductive coil that produces an alternating magnetic field when current is applied to the coil. The magnetic field is used to heat metal containers such as tubular containers. The coil extends about a heating path of travel that extends along the longitudinal axis of the coil. A transport device is provided to move the container through the magnetic field such that the longitudinal axis of the container is generally perpendicular to the longitudinal axis of the coil. This allows for heating the container at the twelve and six o'clock positions. The transport device functions to roll the container along the heating path. In a preferred embodiment, the coil is wrapped about a core with a generally rectangular shape. Ferromagnetic members may optionally be used to further shape the magnetic field. The methods and apparatus may be used for regular or irregularly shaped containers.

11 Claims, 8 Drawing Sheets

(56) References Cited

U.S. PATENT DOCUMENTS

| | | | | |
|---|---|---|---|---|
| 5,349,165 | A * | 9/1994 | Doljack | B29C 65/3668 219/633 |
| 5,529,703 | A | 6/1996 | Sprenger et al. | |
| 5,821,504 | A * | 10/1998 | Sprenger et al. | 219/635 |
| 7,015,436 | B2 * | 3/2006 | Fila et al. | 219/622 |
| 2004/0079750 | A1 * | 4/2004 | Takagi et al. | 219/624 |
| 2007/0068911 | A1 * | 3/2007 | Gerth | B23K 35/404 219/137 R |
| 2010/0026989 | A1 * | 2/2010 | Wildenbeest et al. | 356/53 |
| 2010/0189909 | A1 | 7/2010 | Dixon et al. | |
| 2011/0080239 | A1 * | 4/2011 | Westphal | G01R 33/3815 335/21 |
| 2011/0220249 | A1 * | 9/2011 | Bogicevic et al. | 148/108 |
| 2011/0240633 | A1 * | 10/2011 | Rudnev et al. | 219/653 |
| 2012/0295358 | A1 * | 11/2012 | Ariff et al. | 436/47 |

FOREIGN PATENT DOCUMENTS

| | | |
|---|---|---|
| DE | 10 2009 056320 | 8/2010 |
| FR | 1 217 338 | 5/1960 |
| GB | 905131 | 9/1962 |
| GB | 1 021 928 | 3/1996 |
| JP | 09002432 | 1/1997 |
| JP | 09129191 | 5/1997 |

OTHER PUBLICATIONS

First Office Action in corresponding Chinese Application No. 201280022771.X dated Mar. 6, 2015.

Japanese Application No. 2014-510347: Notification of Reasons for Refusal dated Feb. 23, 2016.

* cited by examiner

INDUCTION OVEN FOR CURING COATINGS ON CONTAINERS

TECHNICAL FIELD OF THE INVENTION

The invention relates generally to material application systems, for example but not limited to powder coating material application systems. More particularly, the invention relates to magnetic induction heaters for curing or partially curing applied coating material on interior surfaces of containers such as tubular containers and cans, for example.

BACKGROUND OF THE INVENTION

Material application systems are used to apply one or more coating materials in one or more layers to interior or exterior surfaces of an object or workpiece. General examples are powder coating systems, as well as other particulate material application systems such as may be used in the food processing and chemical industries. Some containers have liquid coatings applied to interior or exterior surfaces. These are but a few examples of a wide and numerous variety of systems used to apply coating materials to an object and to which the present inventions will find use.

After a coating material, either liquid or powder, has been applied to a container interior surface, the coating material must cure. Many coating materials especially powder are cured with heat. The heat curing process may involve several steps, but one known process of curing coating materials is to use an induction heater to heat the container thereby curing the coating material. In some cases, an induction heater is used to partially cure the coating material, and the coating material thereafter reaches complete cure in an ambient environment or through additional curing steps.

SUMMARY OF THE DISCLOSURE

In one embodiment, a method for at least partially curing a coating material on a tubular container includes the steps of generating an alternating magnetic field, and moving a tubular container along a heating path through the magnetic field in a direction that is generally perpendicular to the longitudinal axis of the container body. In a more specific embodiment, the container is rolled in a direction that is generally perpendicular to the longitudinal axis of the container body. In still a further embodiment, the heating path lies along a longitudinal axis of a coil used to generate the magnetic field. In a still further embodiment the method includes the step of generating a magnetic field by forming a coil with a generally rectangular shape.

In another embodiment, a method for at least partially curing a coating material on a tubular container includes the steps of generating an alternating magnetic field, and rolling a tubular container about its longitudinal axis along a heating path through the magnetic field. In a more specific embodiment, the container is rolled in a direction through the magnetic field that is generally perpendicular to the longitudinal axis of the container body. In still a further embodiment, the heating path lies along a longitudinal axis of a coil used to generate the magnetic field. In a still further embodiment the method includes the step of generating a magnetic field by forming a coil with a generally rectangular shape.

In another embodiment, an apparatus for at least partially curing a coating material on surfaces of a tubular container includes a magnetic induction heating coil that extends about a heating path, and a transport device for moving a tubular container along the heating path through the heating coil in a direction that is generally perpendicular to the longitudinal axis of the container body. In still a further embodiment, the heating path lies along a longitudinal axis of a coil used to generate the magnetic field. In another embodiment the coil is wrapped in a generally rectangular shape.

In another embodiment, an apparatus for at least partially curing a coating material on a tubular container includes a magnetic induction heating coil that extends about a heating path, and a transport device for rotating the tubular container about the longitudinal axis of the container body when the tubular container is moved along the heating path. In still a further embodiment, the heating path lies along a longitudinal axis of a coil used to generate the magnetic field. In another embodiment the coil is wrapped in a generally rectangular shape.

These and other aspects and advantages of the present invention will be apparent to those skilled in the art from the following description of the preferred embodiments in view of the accompanying drawings.

DETAILED DESCRIPTION OF THE INVENTION AND EXEMPLARY EMBODIMENTS THEREOF

The embodiments disclosed herein are directed to methods and apparatus for at least partially curing or curing coating materials that have been applied to surfaces of containers. While the descriptions herein relate specifically to interior surfaces, the inventions may find application for exterior surfaces. While the various embodiments are also presented in the context of coating materials applied to interior surfaces of tubular containers, such description is not intended to be limiting but rather to include any container having a generally cylindrical shape, whether of a regular or irregular shape, including cans. Furthenuore, the exemplary embodiments illustrate a configuration of an induction heater, such is not intended to be limiting. Any general design of an induction heater may be used to carry out the inventions herein, including well known parts such as coils, controls, motors and so on. The inventions rather are directed to disclosed aspects of new ways to provide or use an induction heater for containers, for example having to do with how the containers are moved through the magnetic field produced by the coil and, optionally, the coil shape. The inventions will find applications for curing or partially curing liquid or particulate coatings. The containers may be open ended cylinders or may include a closed end, for example in the nature of a two or three piece container or mono-block container. We refer to the main cylindrical body as the sidewall of the container and the closure element being the end or end plate.

We use the term "generally rectangular" in a broad sense to mean that the induction coil may be wound so as to take on a rectangular looking profile when viewed end on. The coil being rectangular does not require sharp corners for example or even tight radiuses at the corners necessarily. Rather, rectangular means that the coil is characterized by four sides in which opposing pairs of generally parallel sides lie transverse but not necessarily perpendicular the other pair of opposing parallel sides. A generally rectangular coil may be formed, for example, by wrapping a number of wires about a rectangular core (which also need not have sharp corners), along a length that defines the longitudinal axis of the coil. Thus, depending on the wire size and pitch of the wrapped wires, the wire coil may also take on the appearance of a parallelogram that is not a perfectly formed rectangle shape even when wound about a generally rectangular core.

Figures 3, 6A:
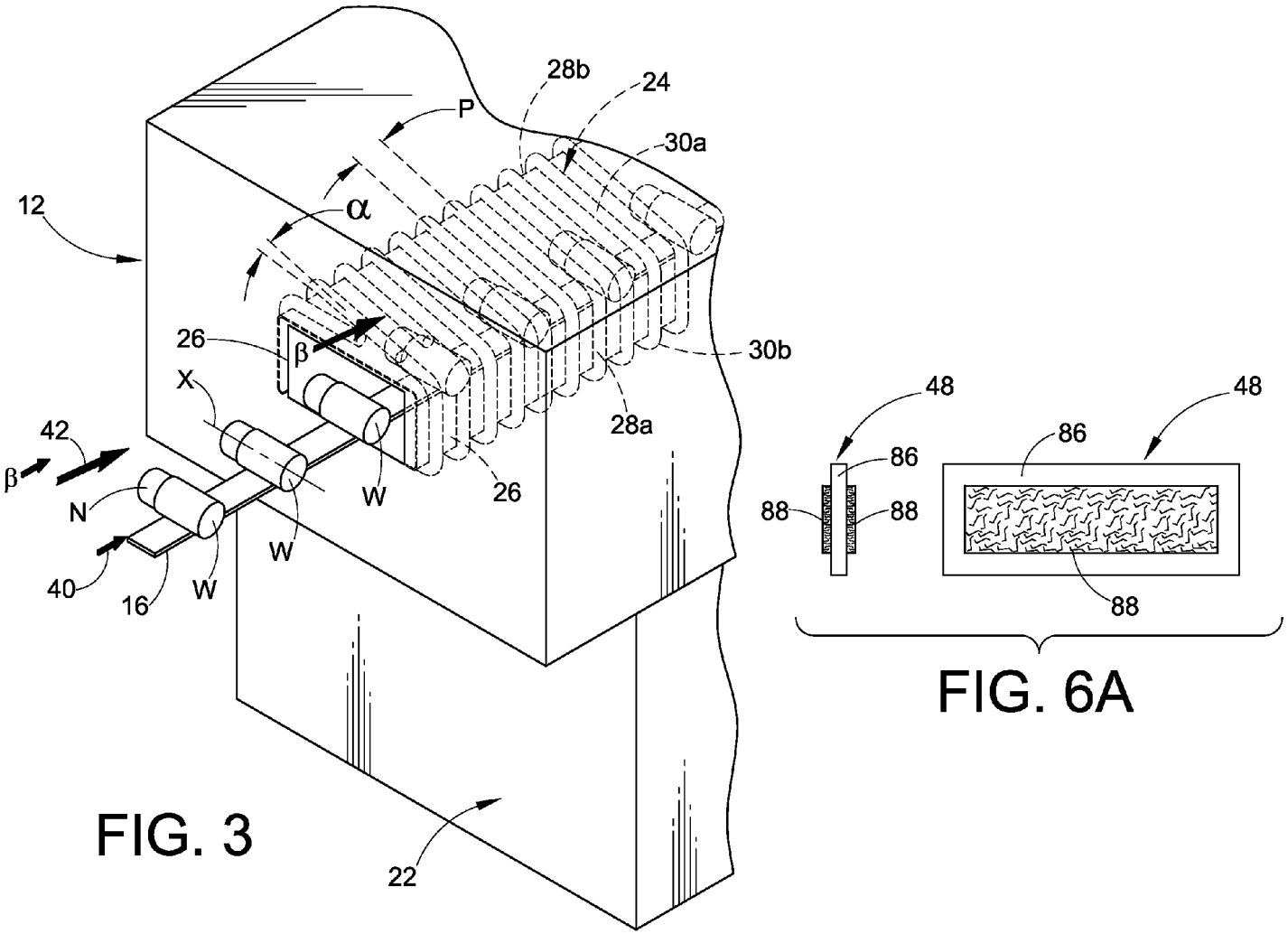
FIG. 3 is an enlarged illustration of the entrance end of the induction apparatus of FIG. 2.
FIG. 6A illustrates a side elevation and plan view of a ferromagnetic assembly that may optionally be used in an induction heater.
Figure 6:
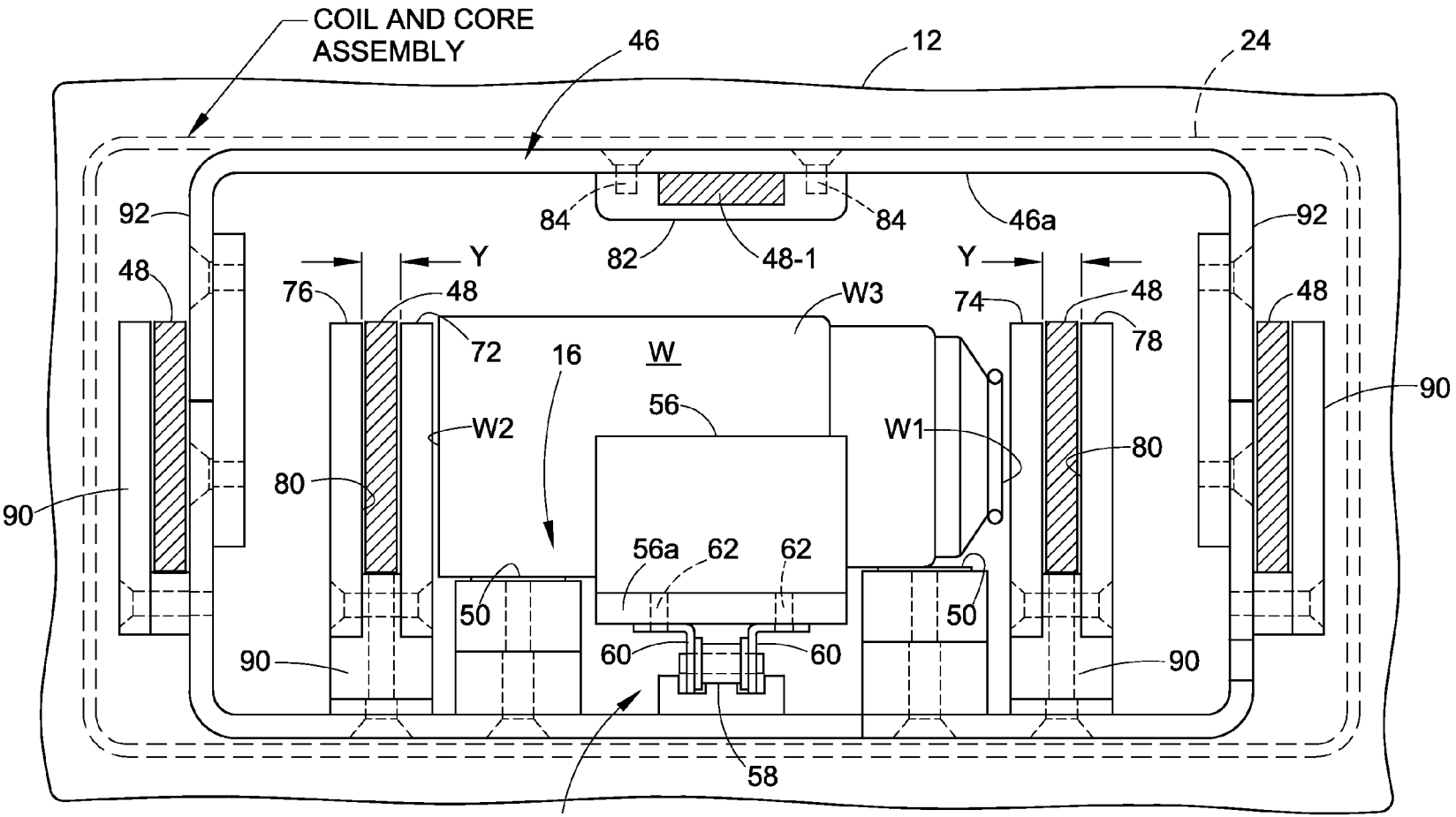
FIG. 6 is a simplified schematic entrance side end view of an induction tube and related parts for an induction heater and transport device.

The exemplary embodiments use a rectangular coil in part because tubular containers tend to have a generally rectangular shape when viewed from the side profile of the container body, see FIGS. 3 and 6 for example. However, many containers have irregular shapes or have rectangular profiles combined with tapers and can ends that have more complex geometries. But for the broader principles herein and concepts of the inventions disclosed herein, the induction coil may be shaped as needed (along with a core) in the form of a non-circular coil that broadly approximates the container body profile.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

Figure 1:
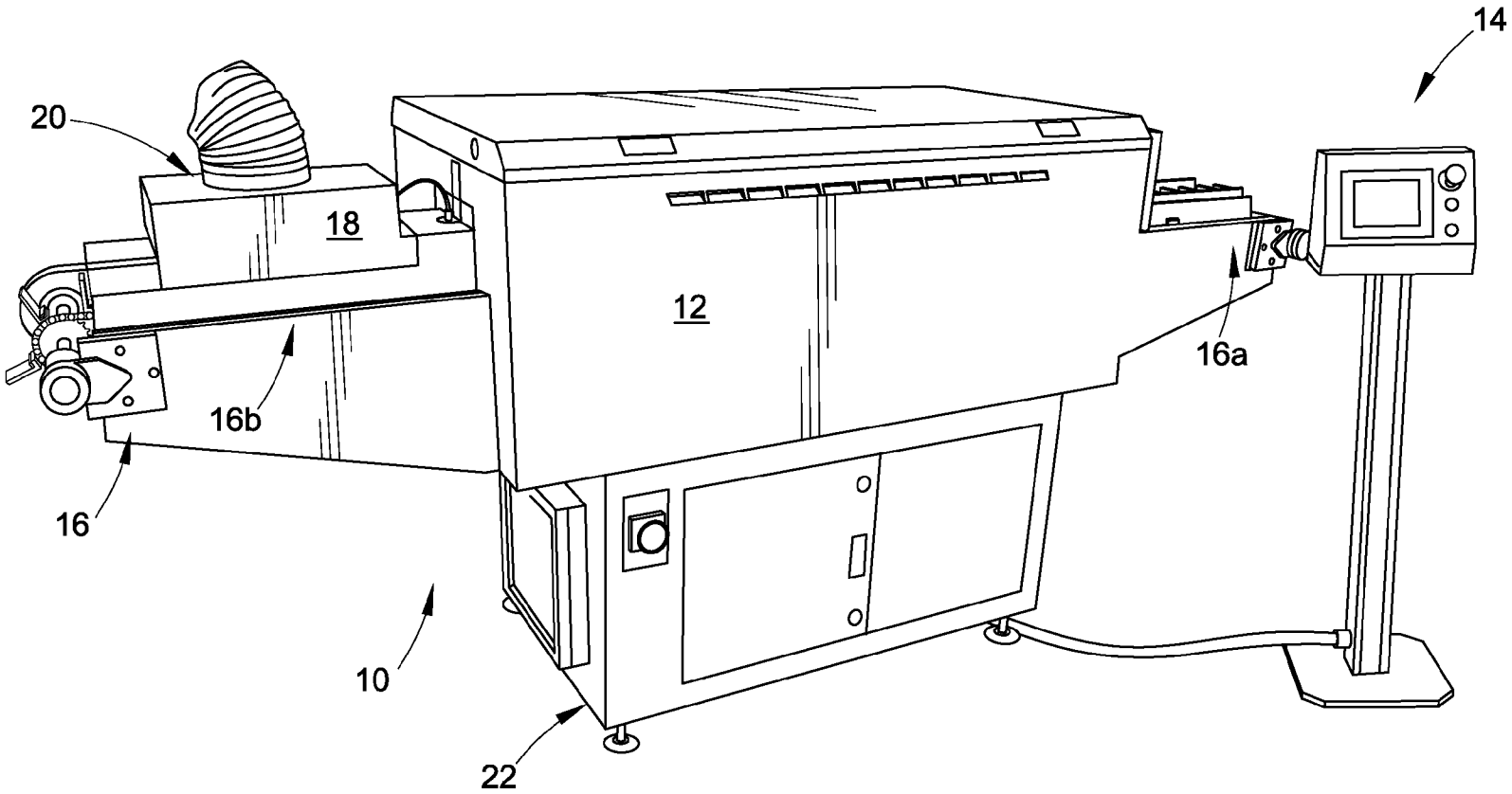
FIG. 1 illustrates an embodiment of an induction heating apparatus in accordance with the present inventions.
Figure 2:
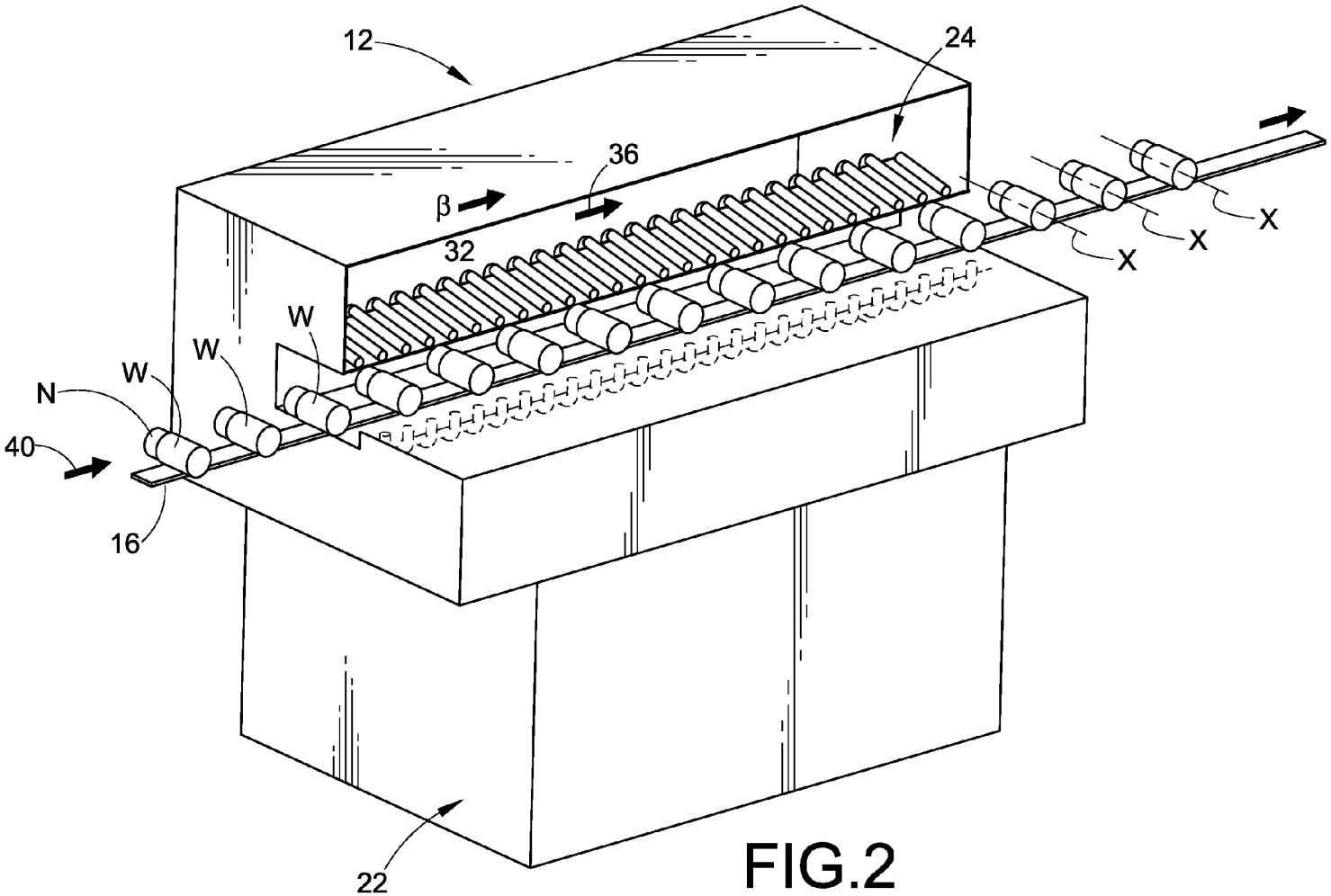
FIG. 2 is a schematic representation of an induction heating apparatus showing workpieces traveling through an induction coil.

With reference to FIG. 1, we illustrate an embodiment of an induction heater or oven 10 that embodies the present inventions. Herein we will use the terms induction heater and induction oven interchangeably. The induction heater 10 is an apparatus that may be used to at least partially cure or completely cure a coating material that has been applied to surfaces of a tubular container or other generally cylindrical workpiece W (FIG. 2). In the exemplary embodiments the coating material has been applied to an interior surface. The interior surfaces may be smooth or irregular in contour and the workpiece itself may be irregular in shape or a simple cylinder. The workpiece may be an open cylinder at both ends or have a closed end that will also need to be heat cured.

The induction heater 10 may include several basic parts, including an induction coil (24, FIG. 2) disposed within a main housing 12. The outer main housing 12 preferably is made of magnetic material so as to contain the magnetic fields generated by the induction heating coil. Also within the housing 12 may be one or more optional ferromagnetic members (items 48, FIG. 6) that can be used to shape the magnetic field that is produced by the induction coil. A control panel 14 may be provided in a convenient manner such as a standalone console or part of the main unit. The control system via a panel 14 may be used to execute operation of the induction heater 10 including the application of current to the induction coil, control of the workpiece transport device and so on. The particular control system and panel 14 and operator interface used with the apparatus 10 forms no particular part of the present disclosure and may be conventional in design as well known in the art or specifically developed for a particular curing operation, such as for controlling current, voltage and power of the induction heating system. An exemplary control system for an induction heater is described in U.S. Pat. No. 5,529,703 issued on Jun. 25, 1996 the entire disclosure of which is fully incorporated herein by reference, but many other control systems and interfaces may be used as needed.

The induction heater 10 also may include a transport device 16 which may be but need not be under the control of the control system 14. The transport device 16 is used to move the workpieces 16 through the induction heater 10, specifically through the magnetic field produced by the induction coil within the housing 12. The transport device 16 includes a loading or inlet end **16*a* and an unloading or outlet end 16*b*. The outlet side of the apparatus 10 may include a hood 18 with an attached exhaust pipe 20 that is connected to a suction apparatus (not shown). The hood is used to extract fumes that may be produced during the curing or heating process, thus the housing 12 is also intended to be tightly enclosed to contain fumes. The extraction hood 18 may also be integrated with the main housing 12** if so desired.

The exemplary embodiments illustrated herein are for an air cooled induction coil, and the cooling equipment such as blowers (not shown) may be disposed in a lower utility bay 22 along with other control equipment as needed. Alternatively, the induction heater 10 may be equipped for water cooling as is known in the art.

With reference to FIGS. 2 and 3, within the housing 12 resides an induction coil 24. The coil 24 is wrapped about a non-magnetic core 26, for example, a box shaped generally rectangular piece of fiberglass. Although the coil 24 is wrapped about a rectangular core, the coil will typically be wrapped with a pitch P between each loop so that each turn of the coil has more of a parallelogram profile, and the coil may take on a helix shape albeit with straight parallel side portions. The number of turns, the amount of pitch and the associated pitch angle $\alpha$ of the coil will depend on the nature of the magnetic field needed for heating. These factors will vary depending on the type of container being heated, the material of the container, the properties of the coating material, the type of wire used in the coil, the power levels used and so on. In some applications more than one coil 24 may be wrapped about the core 26. Each coil is typically made up of a plurality of wires bound together by a shroud or other suitable binding or sheath. The coil 24 is also typically affixed to the core 26 by a suitable material such as epoxy for example.

Figure 4:
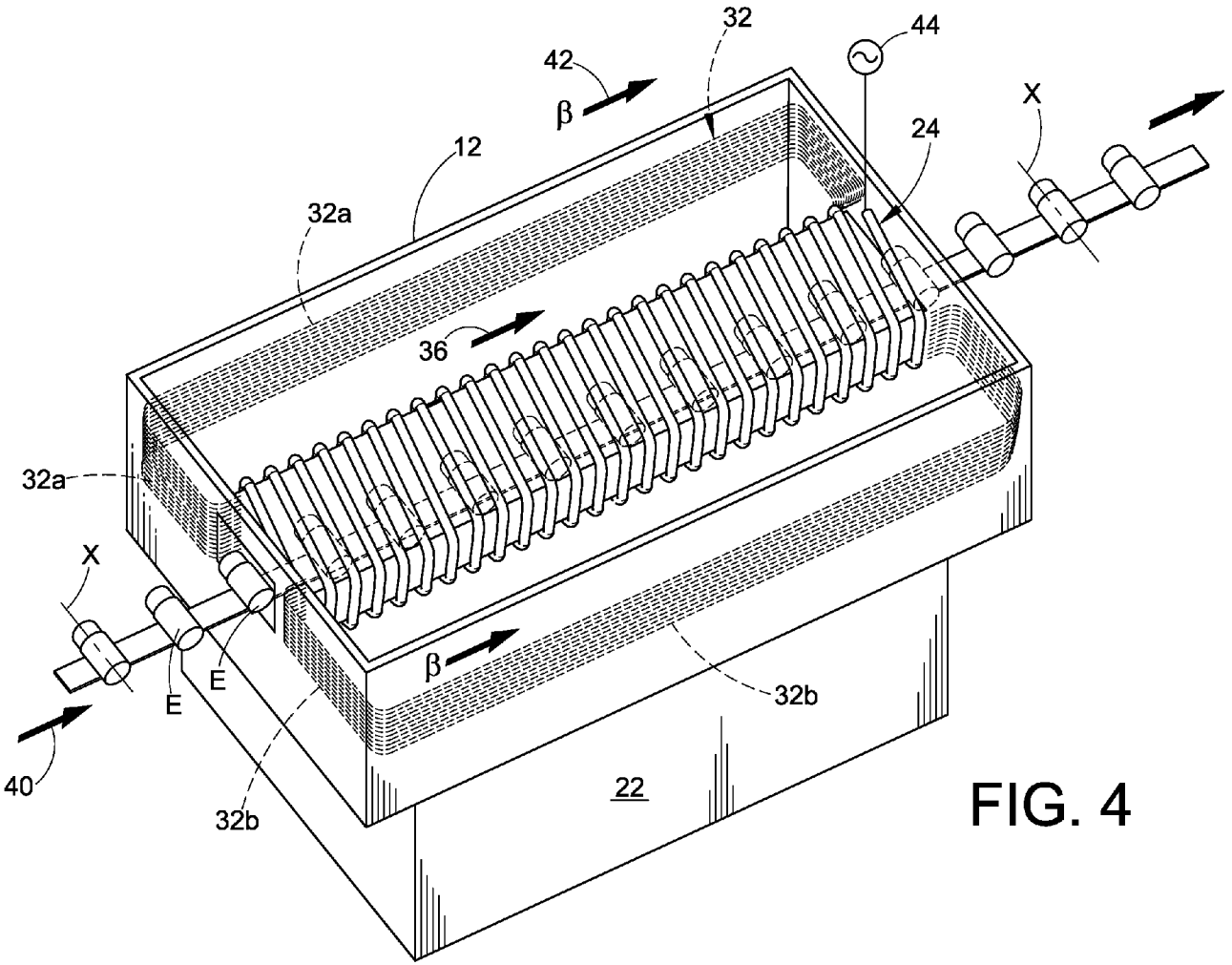
FIG. 4 is the apparatus of FIG. 2 showing side portions of a magnetic field produced by an induction coil.
Figure 5:
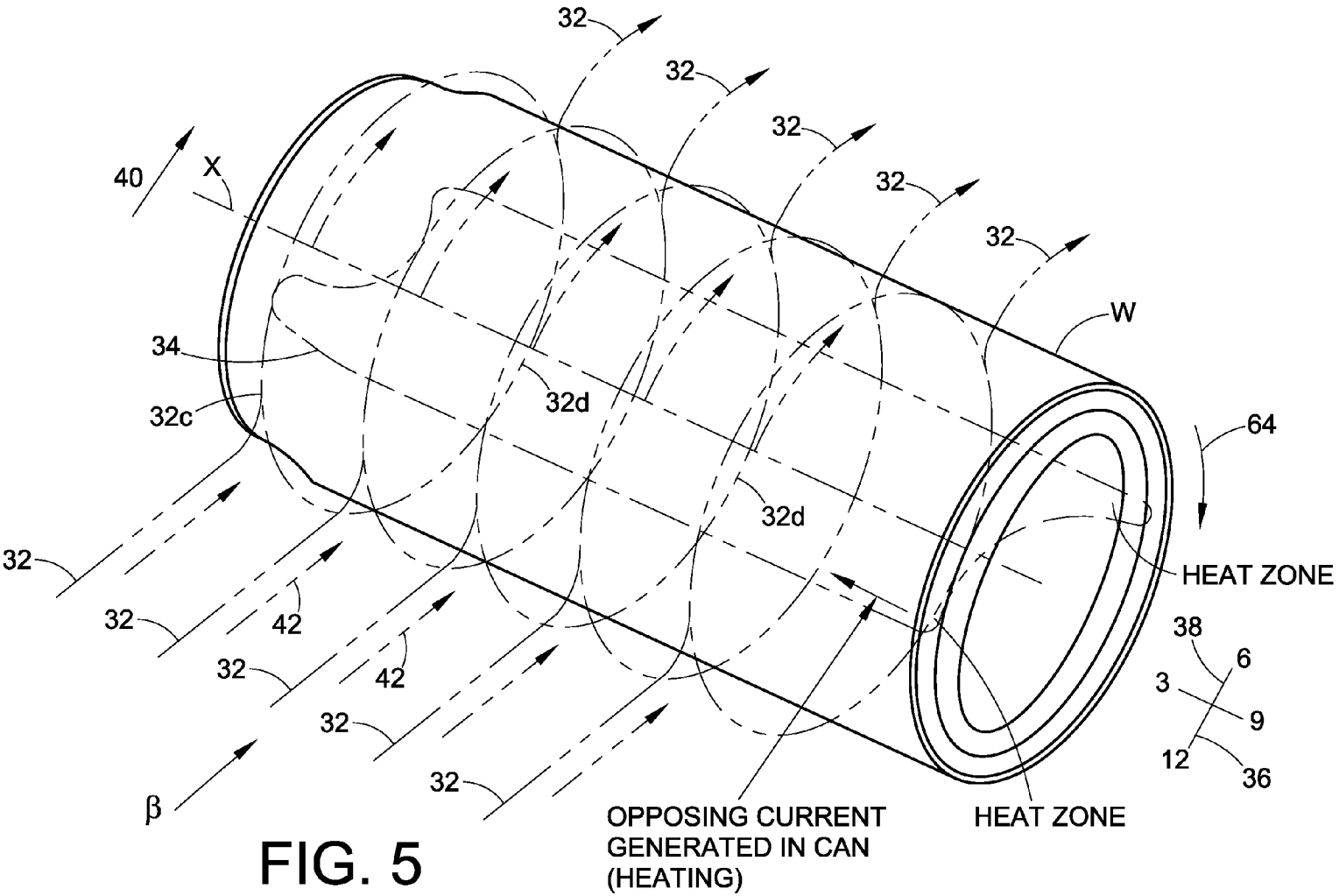
FIG. 5 is a schematic representation of a workpiece passing through a flux field produced by the induction coil.

With additional reference to FIGS. 3 and 4, as just noted the coil 24 has a profile such that there are generally parallel side portions 28*a* and 28*b* for each coil loop and generally parallel top and bottom portions 30*a* and 30*b*. This results in a general magnetic field 32 shape having generally parallel side portions 32*a* and 32*b* (FIG. 4) and generally parallel upper and lower portions 32*c* and 32*d* (FIG. 5). The magnetic field 32 has a desirable characteristic that as the workpieces pass through the magnetic field, magnetically induced eddy currents 34 will be generated within the workpiece body in accordance with the right hand rule. These currents 34 will heat the workpiece, especially at the twelve o'clock and six o'clock portions, 36 and 38 respectively (FIG. 5) relative to the surface area where the workpiece body transversely and preferably perpendicularly passes through the magnetic field 32, much like when a conductive wire passes through a magnetic field. The workpieces will of course experience heating in other portions of the container body but pronounced heating will occur at the twelve and six o'clock positions. The magnetic field side portions 32*a* and 32*b* (FIG. 4) are useful for heating the container end E when present. The represented flux lines are a visual construct, or course, but aid in understanding how the workpieces are heated with the exemplary embodiments. Note the representation in FIG. 4 that the radiated magnetic field 32 is contained in the magnetic walls of the housing 12 and down through the core 26.

As represented schematically in FIG. 4, the induction coil 24 has an alternating current applied thereto by a power source 44. Alternatively, pulsed currents may be used as is well known in the art. The power source 44 may be controlled using the associated control system via the control panel 14. The representation in FIG. 4 is highly simplified, wherein the control system will monitor current, voltage and temperature of the workpiece and adjust the applied current/voltage accordingly, as is well known in the art. Alternatively these adjustments may be made manually as is known in the art. The applied alternating current results in an alternating magnetic field 32 that provides excellent induction of currents in the workpieces. The applied frequency and power may be chosen based on a number of factors, one of which is the workpiece material. For poorly conductive workpieces like steel cans, lower power may be used, while for higher conductivity materials such as aluminum cans higher power may be needed. Frequency ranges may also be selected to optimize heating, wherein a medium frequency induction heater may have a frequency in the range of 5 kHz-15 kHz, whereas a higher frequency induction heater may use 100 kHz-1 Megahertz. The medium frequency induction heater typically can be air cooled while the higher frequency induction heater may require water cooling. In general, as is known, the power level may be set for a fixed or known load, resulting in a predictable and repeatable output and heating performance.

The coil 24 may be made of any suitable material as is well known. For lower current systems, magnet wire made of copper such as is commonly used for motor coils may be used. For higher currents, it may be desirable to use Litz wire which is more efficient in reducing heating of the coil. When needed, water cooled tubing may be used when operating at higher power and higher frequencies.

The transport device 16 is schematically represented in FIGS. 2 and 3 as a simple conveyor belt. As represented by the arrow 40, the transport device 16 moves the workpieces W through the coil 24 and its associated magnetic field 32 along a heating path or direction of travel 40 that is parallel with the direction of the magnetic force field 32 produced by the coil 24. The direction of the magnetic field 32 is represented generally by the arrow 42 in FIG. 3.

The containers or workpieces W as noted above are generally cylindrical in profile although they may have irregularly shaped portions such as reduced necks N. In any case, each container will have a longitudinal axis X, which typically will also be an axis of symmetry. We only label X on some of the illustrated containers for simplicity.

In accordance with another inventive aspect then of this disclosure then and best illustrated in FIG. 5, the transport device 16 moves the workpieces through the magnetic field 32 and the coil 24 such that the direction of travel or heating path 40 is transverse, and in this embodiment generally perpendicular, to the longitudinal axis X of the workpiece. Thus, in the illustrated embodiments, the transport device 16 moves the workpieces sideways through the magnetic field 32 in a direction of travel 40 that is generally perpendicular to the longitudinal axis X of the workpiece but generally parallel the direction 42 of the magnetic field 32. We refer to generally perpendicular because depending on the way that the coil 24 is wrapped about the core 26, the magnetic field may be in a direction that is not precisely parallel with the transport device direction of travel 40. By having the containers move sideways through the magnetic field 32 produced from a generally rectangular coil, the heating effect can be concentrated at the six and twelve o'clock positions. The sideways movement also allows the induction heater 10 to be used to heat a container end E. Also as further explained herein below, the transport device 16 also causes the container to rotate about its longitudinal axis, or in other words roll on its sidewall as it moves through the induction coil 24, as represented by the arrow 64.

It should be noted that although a generally rectangular coil profile is preferred, such is not required. The rectangular profile we have discovered works well for generally cylindrical containers, with or without irregular shaped portions, and is more efficient than, for example, a cylindrical coil; especially when the container is rotated about its longitudinal axis as it moves through the magnetic field in a direction of travel that is generally parallel the magnetic field and transverse the container longitudinal axis. Particularly with the use of ferromagnetic field shaping elements described below, other coil profiles, even cylindrical, may alternatively be used to carryout localized heating of the container sidewall and end when the container is rolled through the magnetic field along a direction of travel or heating path that is generally parallel to the magnetic field but transverse and preferably generally perpendicular to the longitudinal axis of the container (i.e. the axis of rotation).

Although the exemplary embodiments show heating at the six and twelve o'clock positions, such is not necessarily required and the magnetic field may be shaped or presented to the workpieces in such a way to heat different portions of the workpiece body.

Because the container may have an irregular shape in portions, such as for example a reduced neck, the coil may be shaped so as to produce the proper orientation of the magnetic field that will be presented to those irregularly shaped portions. As discussed further below, ferromagnetic members may also be used to further shape the magnetic field not only to accommodate irregular shaped portions but also for heating a container end, and also improving efficiency by concentrating the magnetic field at desired locations.

Having described the basic concepts and configuration for the inventions, we will now describe an exemplary detailed embodiment for the transport device and other optional features of the induction heater 10.

Figure 7:
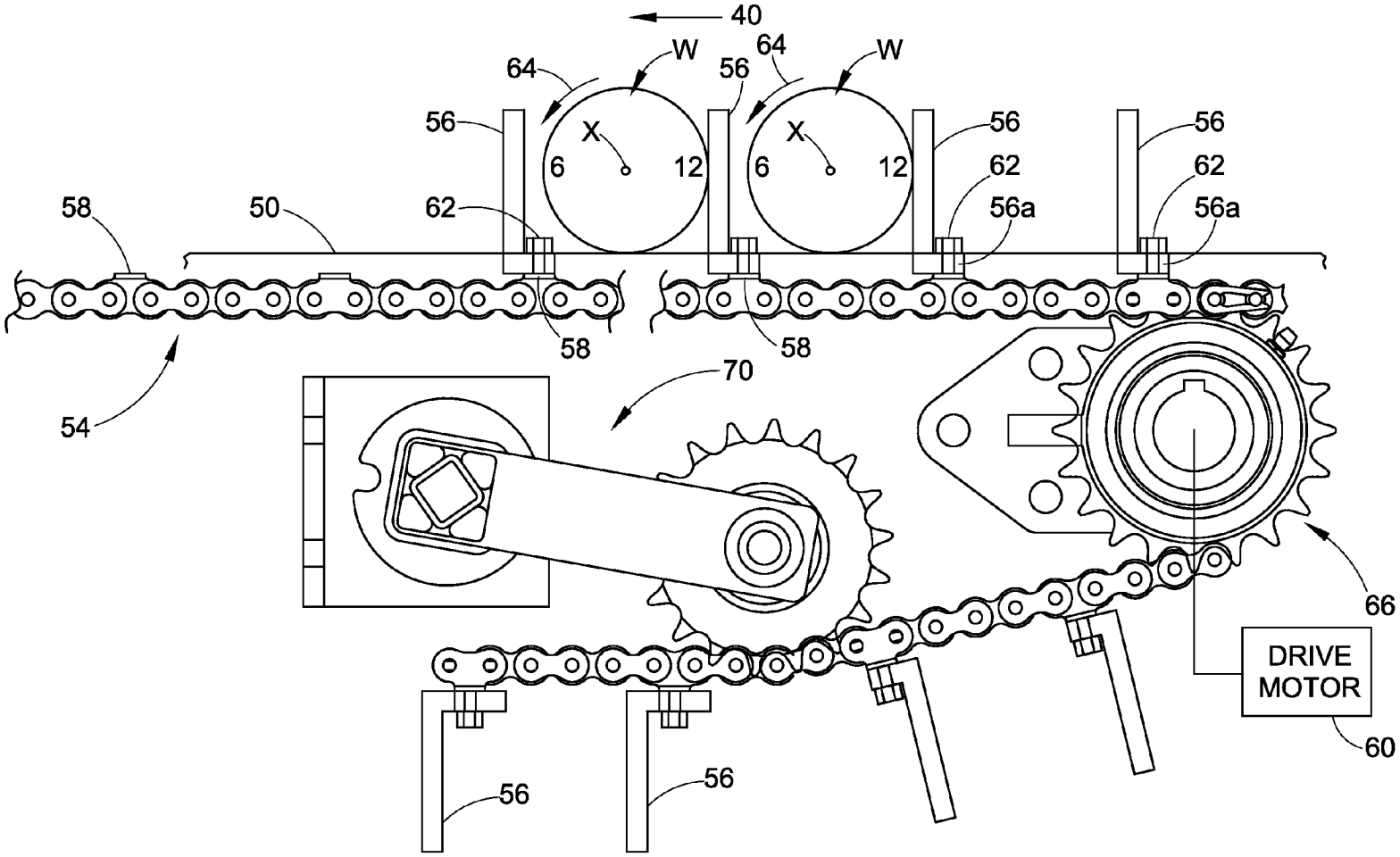
FIG. 7 is a partial schematic illustration of a transport device used to move containers through an induction tube.

With reference to FIGS. 6 and 7, the induction coil 24 resides within the housing 12. An induction tube 46 is provided within the induction coil and core assembly 24, 26. The induction tube 46 is made of non-magnetic materials such as fiberglass construction for example. The induction tube 46 serves as a support frame for one or more optional ferromagnetic members 48. The induction tube 46 also supports part of the transport device 16 which includes a stationary friction surface 50 and a conveyor system 52.

The conveyor system 52 provides an arrangement for moving the workpieces W through the apparatus 10, and more specifically through the magnetic field 32 of the induction coil 24. Due to the magnetic fields present inside the induction heater 10, the transport device 16 is made entirely of non-magnetic parts.

The conveyor system 52 includes a link chain 54, such as for example made of non-magnetic stainless steel, on which are mounted and spaced apart from each other a series of L-shaped pusher lugs 56. Each pusher lug 56 is mounted by its short leg 56*a* on a link 58 of the chain 54 using a pair of support arms 60 each attached on either side of the link 58. Bolts 62 may be used to secure the pusher lug 56 to the link 58.

From FIG. 7 it will be noted that the conveyor chain 54 is disposed below the level of the friction surface 50. This assures that the workpieces actually rest on the stationary friction surface 50. Each workpiece W nests between two adjacent pusher lugs 56 and on top of the friction surface 50. As the conveyor chain 54 moves, the pusher lugs 56 contact the workpiece W and push the cans forward along the heating path 40 through the induction coil 24. Because the workpieces rest on the friction surface 50, the workpieces will roll on their sides by rotation about their longitudinal axis X as represented by the arrow 64. We include the six and twelve o'clock legends on FIG. 7 so that it will be readily understood that as the workpieces roll the entire workpiece body is exposed uniformly to the induced currents and resultant heating. The workpieces therefore are uniformly and efficiently heated even though at any given instant in time the heating is rather localized, for example in this embodiment at the six and twelve o'clock positions. Other techniques may be used to cause the workpieces to roll on their sides as they pass through the magnetic field 32 such that each workpiece is uniformly heated by the induced currents.

A conventional sprocket assembly 66 that is driven by a motor 68 may be used to control the speed of the conveyor chain 54, under the control of the control system used for the apparatus 10. A tension arm and sprocket 68 may be provided as needed to properly maintain tension on the chain 54 for accurate speed control.

With reference to FIG. 6, a first inner side plate 72 and a second inner side plate 74 extend along either side of the transport device 16 through the length of the induction tube 46 and also beyond to the unloading end 16*b* (FIG. 1). These inner side plates also extend back to the inlet or loading end of the transport device 16*a* (FIG. 1). At the loading side 16*a* these side plates may funnel somewhat towards the inlet to the induction tube 46 to help gently align containers that have perhaps been loaded somewhat askew onto the conveyor system 52. Within the induction tube 46 however, the inner side plates 72, 74 run parallel to each other, with the separation between the first and second inner side plates 72, 74 being chosen so as to closely contain but not contact the ends W1 and W2 of the workpiece W within the induction tube 46. It is desirable to have the ends W1, W2 close to the respective side plates to be in close proximity to the ferromagnetic members 48, but with enough of a gap that the workpieces do not rub up against side plates. The parallel friction surfaces 50 on either side of the conveyor assembly 52 along with the pusher lugs help maintain this narrow spacing while the containers roll along through the induction tube 46.

Spaced apart from the inner side plates 72, 74 and coextending parallel therewith through the induction tube 46 are first and second outer side plates 76, 78. All four side plates 72, 74, 76 and 78 are made of non-magnetic material, such as fiberglass, high temperature polymers and plastics, for example Teflon and Nylon, and so on. The spacing distance or gap Y between adjacent pairs of the inner and outer side plates (72/76 and 74/78) defines a slot 80 is selected so as to closely receive and hold the ferromagnetic members 48.

The ferromagnetic members 48 positioned along the workpiece ends in the slots 80 are selected in terms of number and location so as to shape the magnetic field 32 to optimize heating of the ends W1 and W2. In addition, ferromagnetic members 48-1 may be disposed on the inside top wall 46*a* of the induction tube 46, using a bracket 82 that is attached to the inside wall such as with bolts 84. These members 48-1 may be spaced along the top of the induction tube 46 as needed to shape the magnetic field to optimize heating the workpiece sidewall W3. These members 48-1 may also be used for shaping the magnetic field to accommodate irregular shapes of the container side wall, such as tapers, necks and so on as exemplified in FIG. 6.

From the end view presented in FIG. 6, the ferromagnetic members 48 have a length that is into the sheet of the drawing and may be generally rectangular in shape. Other locations and numbers of ferromagnetic members 48 may be used as needed to achieve a desired magnetic field shape 32.

Because the ferromagnetic material tends to be quite brittle, the members 48 may in practice be assemblies of the actual ferromagnetic element and a side cushion such as made of silicon. As shown in FIG. 6A, the ferromagnetic members 48 may be assemblies of a ferromagnetic element 86 with two side cushions 88 on either planar side that cushion the ferromagnetic element 86 when the member 48 are inserted into the slot 80. The cushions 88 may be attached to the ferromagnetic elements 86 by any suitable means such as, for example, high temperature adhesives, for example, silicon based. For the ferromagnetic members 48-1 that are clamped to the upper wall of the induction tube 46, in a similar manner cushions my be used on either side of the ferromagnetic element, or may be provided on the inside surface 46*a* of the induction tube 46 and the inside surface of the clamp 82.

With the slot 80 design, the ferromagnetic members 48 may be positioned along the slot 80 anywhere along the length of the induction tube 46 and can easily be re-positioned as needed. Also, the side rail assemblies 72/76 and 74/78 may be removable as with mounting bolts 90. Optional additional support side plates 92 may be provided at a greater width so as to allow longer containers to pass through the induction heater. The construction of such side plates may be as already described herein above. In the example of FIG. 6 the optional additional support plates 92 may be disposed on an outside wall 94 of the induction tube 46 because the induction tube 46 is non-magnetic. This would represent the maximum container length that could be accommodated for given size induction tube 46. As another alternative, the inside support rails 72,76 and 74,78 could be re-positioned within the induction tube 46 by providing additional optional mounting sites.

It may be that for simple container shapes the ferromagnetic members will not be needed. It may also be possible that the coil winding may accommodate the container profile being heated without using the ferromagnetic members. But, the optional ferromagnetic members increase overall design flexibility in accommodating differently shaped and sized containers without having to modify the coil. For the same reason, more than one coil may also increase such design flexibility. Moreover, the ferromagnetic members 48 not only may be used to concentrate the magnetic flux in desired locations, but may also be positioned so as to direct magnetic flux away from certain container regions as needed.

Figure 8:
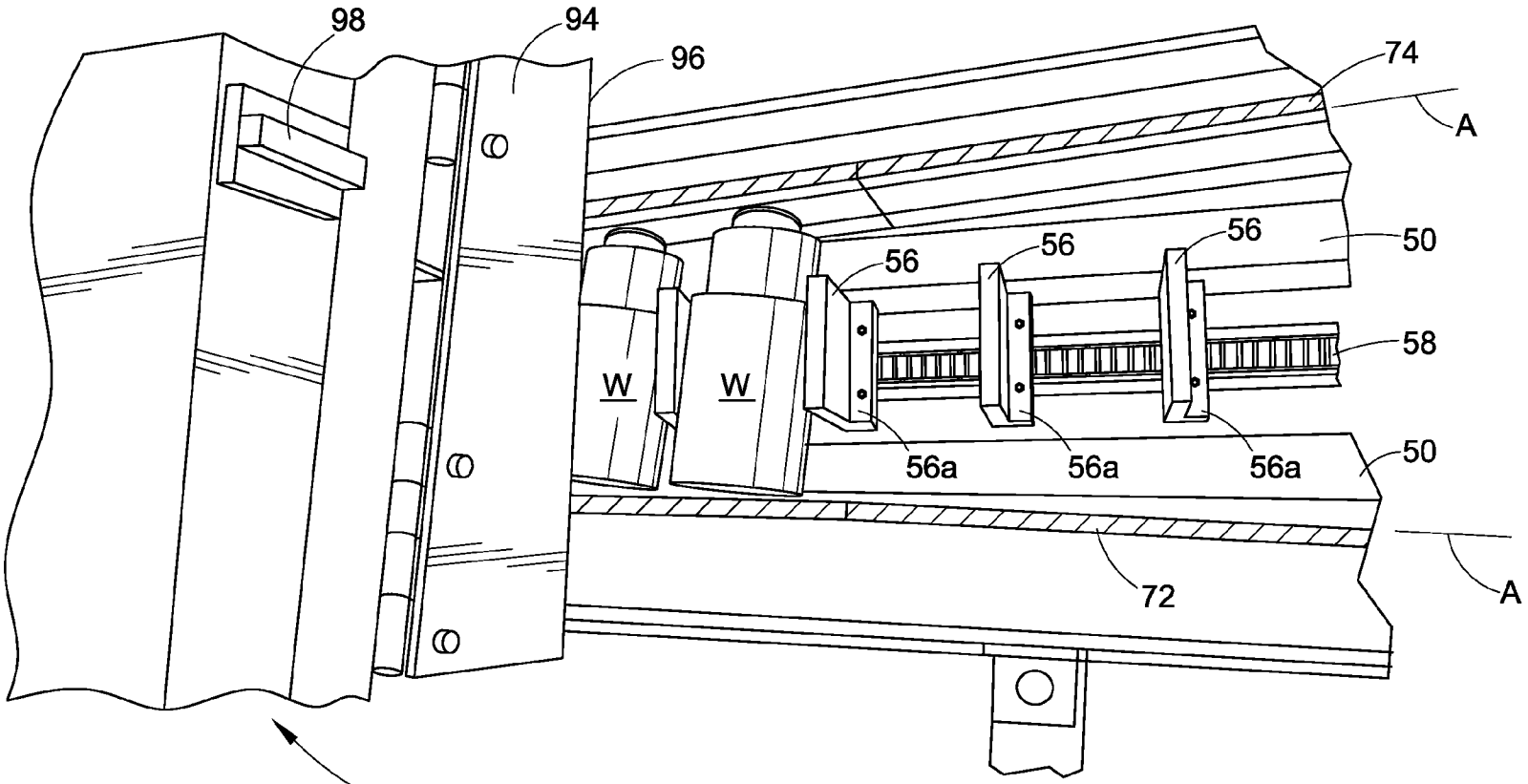
FIG. 8 illustrates an optional guard plate to assist in aligning containers as they enter an induction oven as well as a safety feature.

With reference to FIG. 8 we illustrate an another optional feature. Near the entrance to the induction tube 46 we suspend a hinged guard plate 94. In its natural position the plate 94 may hang vertically with a lower edge 96 positioned in close proximity to the upper surfaces of the workpieces. If a workpiece is not fully nested as shown in FIG. 8, but rather vertically tilted, it will hit the plate 94. This will cause the workpiece to either drop fully down into the nested position between the adjacent pusher lugs 56, or will pivot the plate 94 towards the entrance to the induction tube 46, causing the plate 94 to actuate a proximity sensor 98 or other device for detecting misalignment of the workpiece. Other techniques may be used of course to detect containers that are not properly positioned before entering the induction tube 46. Note that FIG. 8 illustrates the funneled entrance (emphasized with lines A) to the induction tube 46 provided by the side plates 72, 74 for helping align the containers properly as discussed above.

The guard plate 94 may also serve as a safety feature in that if an operator or other person places a hand into the conveyor area too near the induction tube 46 inlet, the hand will pivot the plate and shut off the conveyor. This is useful as a safety device in situations where the apparatus 10 has been operated and there may be hot components near the entrance to the induction tube 46.

As an example, we have found that we can heat a tubular container to a range of about 230° C. (about 400° F.) with as short as 20 second heating times. These numbers vary of course depending on the nature of the coating material as well as the power of the induction heater and design, as well as the container shapes.

The concepts and inventions thus described herein provide apparatus and processes that efficiently heat and at least partially cure coating material on tubular containers, including the capability to heat container ends as well as the container sidewall during the same heating operation as the containers pass through the induction coil. The container rotation allows for simpler coil designs, and evens out hot spots in the ends. It is noted that while rotation is not needed for heating the ends, rotation improves heating the sidewall by more uniformly causing the induction heating currents within the sidewall.

The invention has been described with reference to the preferred embodiment. Modifications and alterations will occur to others upon a reading and understanding of this specification and drawings. The invention is intended to include all such modifications and alterations insofar as they come within the scope of the appended claims or the equivalents thereof.

We claim:

1. Apparatus for at least partially curing a coating material on a tubular container with a longitudinal axis, comprising:

a magnetic induction heating coil that extends about a heating path, the magnetic induction heating coil configured to generate a magnetic field;

a transport device configured to move the tubular container along the heating path through the magnetic induction heating coil in a first direction that is perpendicular to the longitudinal axis of the tubular container when the tubular container is supported by the transport device;

one or more stationary ferromagnetic members affixed within the magnetic induction heating coil, the one or more stationary ferromagnetic members disposed along the heating path between the magnetic induction heating coil and the tubular container supported by the transport device, such that, the one or more stationary ferromagnetic members shape the magnetic field for heating the tubular container; and a support frame disposed within the magnetic induction heating coil, the support frame supporting the transport device and the one or more stationary ferromagnetic members, wherein the transport device is configured to move the tubular container in the first direction with respect to the one or more stationary ferromagnetic members.

2. The apparatus of claim 1, further comprising a non-magnetic induction tube secured within the heating coil, wherein the one or more ferromagnetic members are fastened to the induction tube.

3. The apparatus of claim 2, further comprising one or more support rails fastened to the induction tube for retaining the corresponding one or more ferromagnetic members.

4. The apparatus of claim 3, wherein each of the one or more support rails defines a slot sized to receive a corresponding one of the one or more ferromagnetic members.

5. The apparatus of claim 1, wherein the magnetic induction heating coil includes a top portion, a bottom portion and first and second side portions that surround the heating path.

6. The apparatus of claim 1, wherein the transport device also rotates the tubular container about the longitudinal axis of the tubular container while moving the tubular container through the heating coil.

7. The apparatus of claim 1, wherein the transport device comprises a stationary friction surface, and a moving member that pushes the tubular container to cause the tubular container to roll on the stationary friction surface.

8. The apparatus of claim 1, wherein the transport device comprises a belt that supports a plurality of pusher lugs, a tubular container being disposed between adjacent pair of pusher lugs so that as the belt moves along the heating path the tubular container rolls about its longitudinal axis.

9. The apparatus of claim 1, wherein the heating coil produces an alternating magnetic field to heat the tubular container primarily at the 12 o'clock and 6 o'clock positions of the container.

10. The apparatus of claim 1, wherein the heating coil is wound about a non-magnetic core.

11. The apparatus of claim 1, wherein the one or more ferromagnetic members comprise one or more rectangular plates extending in the first direction.

* * * * *